US009300037B2

(12) United States Patent
Tayama et al.

(10) Patent No.: US 9,300,037 B2
(45) Date of Patent: Mar. 29, 2016

(54) ANTENNA DEVICE AND ANTENNA MOUNTING METHOD

(71) Applicant: Fujikura Ltd., Tokyo (JP)

(72) Inventors: Hiroiku Tayama, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 136 days.

(21) Appl. No.: 14/170,697

(22) Filed: Feb. 3, 2014

(65) Prior Publication Data

US 2014/0176391 A1 Jun. 26, 2014

Related U.S. Application Data

(63) Continuation of application No. PCT/JP2012/071354, filed on Aug. 23, 2012.

(30) Foreign Application Priority Data

Sep. 26, 2011 (JP) ..... 2011-209639

(51) Int. Cl.

| | |
|---|---|
| ***H01Q 1/50*** | (2006.01) |
| ***H01Q 1/38*** | (2006.01) |
| ***H01Q 9/42*** | (2006.01) |
| ***H01P 11/00*** | (2006.01) |

(52) U.S. Cl.

CPC . *H01Q 1/50* (2013.01); *H01Q 1/38* (2013.01); *H01Q 9/42* (2013.01); *H01R 2201/02* (2013.01); *Y10T 29/49018* (2015.01)

(58) Field of Classification Search

None

See application file for complete search history.

(56) References Cited

U.S. PATENT DOCUMENTS

| | | | | |
|---|---|---|---|---|
| 6,292,150 | B1 * | 9/2001 | Doi et al. | 343/713 |
| 8,284,106 | B2 * | 10/2012 | Guan | 343/700 MS |
| 2005/0052334 | A1 | 3/2005 | Ogino et al. | |
| 2008/0111745 | A1 * | 5/2008 | Takada et al. | 343/700 MS |
| 2010/0236810 | A1 | 9/2010 | Mukai et al. | |

FOREIGN PATENT DOCUMENTS

| | | | |
|---|---|---|---|
| CN | 101257147 | A | 9/2008 |
| CN | 101847780 | A | 9/2010 |
| JP | 59-097204 | A | 6/1984 |
| JP | 2002-158535 | A | 5/2002 |
| JP | 2005-236656 | A | 9/2005 |
| JP | 2007-166127 | A | 6/2007 |
| JP | 2009-055299 | A | 3/2009 |

OTHER PUBLICATIONS

Notice of Allowance dated Feb. 10, 2015, issued in corresponding Japanese application No. 2013-536087, with English Translation (3 pages).

(Continued)

*Primary Examiner* — Robert Karacsony

(74) *Attorney, Agent, or Firm* — Westerman, Hattori, Daniels & Adrian, LLP

(57) ABSTRACT

An antenna device (10) includes: an antenna (100) including a radiating element (101) and an internal ground (103); a coaxial cable (200) whose internal conductor (204) is connected with the radiating element (101) and whose external conductor (203) is connected with the internal ground (103); and an external ground (500) capacitive-coupled with the external conductor (203) of the coaxial cable (200).

8 Claims, 7 Drawing Sheets

(56) References Cited

OTHER PUBLICATIONS

Chinese Office Action dated Oct. 29, 2014, issued in corresponding Chinese Patent Application No. 201280036194.X (8 pages).
Notification of Transmittal of Translation of the International Preliminary Report on Patentability (form PCT/IB/338) of International Patent Application No. PCT/JP2012/071354, dated Apr. 10, 2014 with forms PCT/IB/373 and PCT/ISA/237 (5 pages).
International Search Report dated Oct. 2, 2012, issued in corresponding application No. PCT/JP2012/071354.
Japanese Office Action dated Nov. 4, 2014, issued in corresponding Japanese Application No. 2013-536087; w/ English Translation. (5 pages).
Office Action dated Jul. 9, 2015, issued in counterpart Chinese application No. 201280036194.X, with English Translation (19 pages).

* cited by examiner

ANTENNA DEVICE AND ANTENNA MOUNTING METHOD

CROSS-REFERENCE TO RELATED APPLICATIONS

This application is a Continuation of PCT International Application No. PCT/JP2012/071354 filed in Japan on Aug. 23, 2012, which claims the benefit of Patent Application No. 2011-209639 filed in Japan on Sep. 26, 2011, the entire contents of which are hereby incorporated by reference.

TECHNICAL FIELD

The present invention relates to an antenna device for wireless communications. Furthermore, the present invention relates to a method for mounting an antenna on a wireless device.

BACKGROUND ART

Recently, small wireless devices such as mobile phones have been prevailing rapidly, and there is a requirement for small and wideband antennas to be mounted on such wireless devices. An example of an antenna capable of meeting such a requirement is a monopole antenna.

The monopole antenna is an antenna including a radiating element connected with an internal conductor of a coaxial cable and a ground (also referred to as "bottom board") connected with an external conductor of the coaxial cable. In particular, a monopole antenna including a short-circuit section which short-circuits a radiating element and a ground is called an inverted F antenna. Such a monopole antenna can reduce the entire length of a radiating element to approximately ¼ of an operating wavelength, and accordingly is advantageous in terms of downsizing compared to a dipole antenna operating at the same band (whose radiating element is required to have an entire length of approximately ½ of an operating wavelength).

Known examples of a technique for further downsizing the monopole antenna without limiting an operating band are described in, for example, Patent Literatures 1 and 2. Patent Literature 1 discloses an inverted F antenna in which a radiating element (element part) is turned back so as to be downsized. Patent Literature 2 discloses an inverted F antenna in which a ground (second conductor) is notched so as to reduce the area of a bottom board.

CITATION LIST

Patent Literature 1

Japanese Patent Application Publication No. 2009-55299 (published on Mar. 12, 2009)

Patent Literature 2

Japanese Patent Application Publication No. 2007-166127 (published on Jun. 28, 2007)

SUMMARY OF INVENTION

Technical Problem

However, the inverted F antenna described in Patent Literature 1 has a ground (GND part) with a very large area. As above, a conventional monopole antenna (including an inverted F antenna) requires a ground with a very large area (ideally, limitless area), which makes it difficult to downsize the antenna.

In contrast, the inverted F antenna described in Patent Literature 2 is designed to have a notched ground (second conductor), which allows the ground to be smaller than a conventional one. However, the ground still has a larger area than a radiating element (first conductor). Thus, the existence of the ground makes it difficult to downsize the antenna.

In a case where an antenna cannot be downsized, a wireless device on which the antenna is to be mounted is required to have a large space to contain the antenna. Consequently, the problem that an antenna cannot be downsized has an adverse affect on the design of a wireless device on which the antenna is to be mounted.

In particular, wireless devices such as smart phones and electronic book readers have come to have a larger display panel, which narrows a space around the display panel used for containing an antenna. Enlarging the space in order to mount an antenna thereon is not preferable in terms of design. Consequently, an antenna is required to be further downsized so that the antenna can be mounted on such a narrow space.

The present invention was made in view of the foregoing problem. An object of the present invention is to realize an antenna device which can be mounted on a narrower space than a conventional one without limiting an operating band.

In order to solve the foregoing problem, an antenna device of the present invention includes: an antenna including a radiating element and an internal ground; a coaxial cable whose internal conductor is connected with the radiating element and whose external conductor is connected with the internal ground; and an external ground capacitive-coupled with the external conductor of the coaxial cable.

With the arrangement, both of the internal ground and the external ground serve as a ground (bottom board) which is an essential component of a monopole antenna (including an inverted F antenna). Therefore, for example, by using, as the external ground, a substrate originally included in a wireless device including the antenna device, it is possible to reduce the area of the internal ground without limiting a function of a monopole antenna. This allows realizing an antenna whose mounting area is smaller than that of a conventional antenna.

An antenna mounting method of the present invention is an antenna mounting method for mounting, on a wireless device, an antenna including a radiating element and an internal ground, said antenna mounting method comprising the steps of: connecting an internal conductor of a coaxial cable with the radiating element and connecting an external conductor of the coaxial cable with the internal ground; and capacitive-coupling the external conductor of the coaxial cable with an external ground included in the wireless device.

With the antenna mounting method, both of the internal ground and the external ground serve as a ground (bottom board) which is an essential component of a monopole antenna (including an inverted F antenna). Therefore, for example, by using, as the external ground, a substrate originally included in the wireless device, it is possible to reduce the area of the internal ground to be mounted on the wireless device, without limiting a function of a monopole antenna. This allows mounting, on the wireless device, an antenna whose mounting area is smaller than that of a conventional antenna.

Advantageous Effects of Invention

Since the antenna device and the antenna mounting method of the present invention employ a configuration in which both of the internal ground and the external ground serve as a ground, it is possible to minimize the area of the internal ground without limiting a function of a monopole antenna. That is, by employing the present invention, it is possible to realize an antenna device which can be provided on a narrower space compared to a conventional antenna device, without limiting an operating band.

DESCRIPTION OF EMBODIMENTS

The following description will discuss an embodiment of the present invention with reference to drawings.

(Outline of Antenna Device 10)

Figure 1:
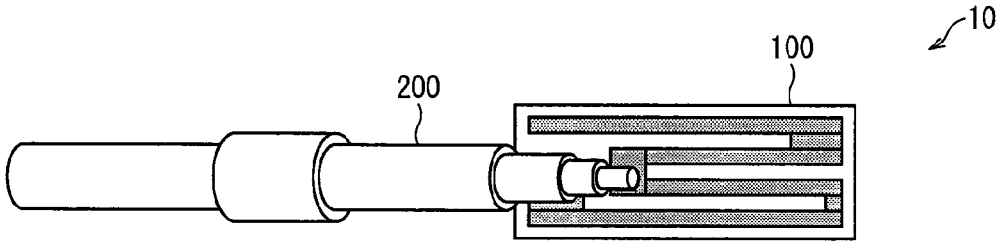
FIG. 1 is a view illustrating a configuration of an antenna device in accordance with an embodiment.

Initially, with reference to FIG. 1, a description will be provided below as to an outline of an antenna device 10 in accordance with an embodiment. FIG. 1 is a view illustrating a configuration of the antenna device 10 in accordance with the embodiment.

As illustrated in FIG. 1, the antenna device 10 includes an antenna 100 and a coaxial cable 200. As described later, the antenna 100 is an inverted F antenna formed on a single plane.

The antenna device 10 for use in wireless devices such as smart phones, mobile phones, electronic book readers, laptop computers, and PDAs, and is employed to carry out wireless communication functions such as data communications, phone calls, and GPS.

(Configuration of Coaxial Cable 200)

Figure 2:
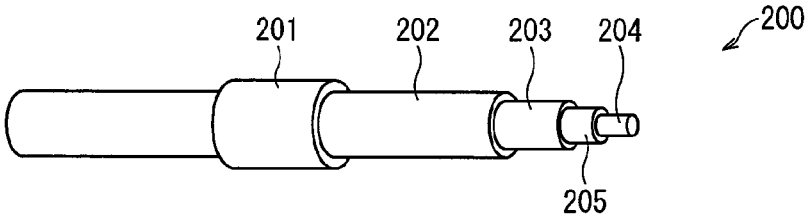
FIG. 2 is a view illustrating a configuration of a coaxial cable in accordance with the embodiment.

With reference to FIG. 2, a description will be provided below specifically as to a configuration of the coaxial cable 200 in accordance with the embodiment. FIG. 2 is a view illustrating the configuration of the coaxial cable 200 in accordance with the embodiment.

The coaxial cable 200 includes an internal conductor 204, an insulator 205, an external conductor 203, and a coverture 202 which are concentrically provided in this order from the inner side toward the outer side of the coaxial cable 200 (see FIG. 2).

The internal conductor 204 is soldered, welded, or otherwise fastened to one power supply point P (see FIG. 3) of the antenna 100, thereby causing them to be electrically connected with each other. The external conductor 203 is soldered, welded, or otherwise fastened to the other power supply point Q (see FIG. 3) of the antenna 100, thereby causing them to be electrically connected with each other.

The insulator 205 is provided for electrically insulating the internal conductor 204 from the external conductor 203. The coverture 202 is provided for (i) protecting the external conductor 203 and (ii) electrically insulating the external conductor 203 from outside. For this reason, the coverture 202 is made of an insulator.

(Conductor 201)

The coaxial cable 200 further includes a conductor 201. The conductor 201 is provided on the coverture 202 so as to be away, by a certain distance, from a leading end of the coaxial cable 200. The conductor 201 can be made of any material. For example, the conductor 201 can be obtained by (i) attaching a conductor such as a relatively thin metal film (e.g. metal tape) or a relatively thin metal plate onto the coverture 202 or (ii) winding such a conductor around the coverture 202.

The conductor 201 is soldered, welded, or otherwise fastened to a substrate 500 (see FIG. 5) of a wireless device on which the antenna device 10 is to be mounted, so that the conductor 201 is electrically connected with the substrate 500. This causes the external conductor 203 of the coaxial cable 200 and the substrate 500 to be capacitive-coupled with each other. Consequently, in the antenna device 10 in accordance with the present embodiment, the substrate 500 of the wireless device can serve as an external ground of the antenna 100.

A distance between a leading end of the coaxial cable 200 and the conductor 201 is set in accordance with an operating band of the antenna 100. That is, the antenna device 10 in accordance with the present embodiment can obtain a desired operating band of the antenna 100 by adjusting such a distance.

(Configuration of Antenna 100)

Figure 3:
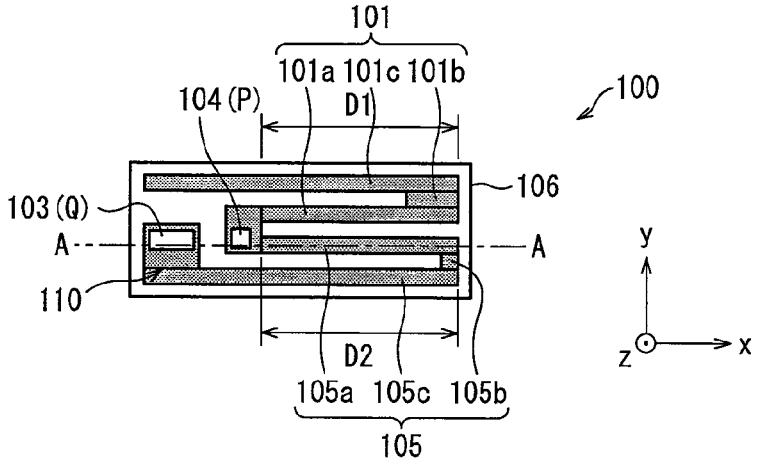
FIG. 3 is an elevation view illustrating a configuration of an antenna in accordance with the embodiment.
Figure 4:
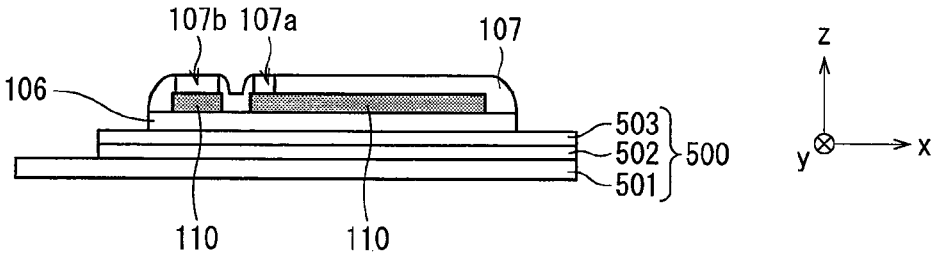
FIG. 4 is a cross sectional view taken along line A-A of the antenna in FIG. 3.

Next, the following description will discuss specifically a configuration of the antenna 100 in accordance with the present embodiment, with reference to FIGS. 3 and 4. FIG. 3 is an elevation view illustrating the configuration of the antenna 100 in accordance with the embodiment. FIG. 4 is a cross sectional view taken along line A-A of the antenna 100 in FIG. 3.

As illustrated in FIG. 3, the antenna 100 includes a radiating element 101, an internal ground 103, a power supply section 104, a short-circuit section 105, and a dielectric substrate 106.

The radiating element 101, the internal ground 103, the power supply section 104, and the short-circuit section 105 (hereinafter collectively referred to as "thin film conductor section 110") are provided to be integrated with each other, by subjecting, to pressing, etching etc., a material such as aluminum and copper which has a thin film shape and electrical conductivity.

The thin film conductor section 110 is provided on the surface of the dielectric substrate 106 so as to overlap the dielectric substrate 106. The thin film conductor section 110 is adhered to the dielectric substrate 106. The dielectric substrate 106 is made of a material such as a thin polyimide film.

(Specific Shape of Thin Film Conductor Section 110)

The power supply section 104 is provided at substantially the center of a plane of the thin film conductor section 110. The radiating element 101 and the short-circuit section 105 extend from the power supply section 104 in a direction (x-axis forward direction in FIG. 3) opposite to a direction in which the coaxial cable 200 is drawn out (x-axis backward direction in FIG. 3). The radiating element 101 and the short-circuit section 105 are drawn out substantially parallel to each other and substantially linearly.

The radiating element 101 is a radiating element intended to operate at a predetermined operating band (e.g. 2412 MHz-2482 MHz band which is a frequency band of Wi-Fi). For this purpose, the radiating element 101 has a length required for operation within the predetermined operating band (approximately a length of ¼ of wavelength λ).

That is, the operating band of the antenna 100 is determined also by the length of the radiating element 101. For example, in a case of shifting the operating band of the antenna 100 toward a low frequency side, it is necessary to adjust the length of the radiating element 101 to be longer. In contrast, in a case of shifting the operating band of the antenna 100 toward a high frequency side, it is necessary to adjust the length of the radiating element 101 to be shorter.

In this case, it is preferable to also adjust the length of the short-circuit section 105 so that a resonance point of the antenna 100 and a resonance point of the short-circuit section 105 are in line with each other. This is because the operating band of the antenna 100 is determined also by the length of the short-circuit section 105. As such, in a case of adjustment of only one of the lengths of the radiating element 101 and the short-circuit section 105, the resonance point of the antenna 100 and the resonance point of the short-circuit section 105 may no longer be in line with each other. This may cause the operating band to be narrow.

The short-circuit section 105 short-circuits the radiating element 101 and the internal ground 103 so that input impedance of the antenna 100 is changed (i.e. a reactance component(s) is cancelled). This allows impedance matching to be easily carried out particularly in a high frequency band.

In particular, for the purpose of widening the operating band and improving a radiation efficiency, the length of the short-circuit section 105 (i.e. the length between the power supply section 104 and the internal ground 103) is set to a length required for an operation in a predetermined operating band (approximately a length of ¼ of wavelength λ), similarly with the radiating element 101.

The radiating element 101 includes (i) a straight line section 101*a* (first straight line section) extending from the power supply section 104 in a direction (x-axis forward direction in FIG. 3) opposite to a direction in which the coaxial cable 200 is drawn out and (ii) a straight line section 101*c* (second straight line section) connected with an end of the straight line section 101*a* (an end of the straight line section 101*a* which end is farther from the power supply section 104) via an intermediary section 101*b* (first intermediary section) and extending in the direction in which the coaxial cable 200 is drawn out (x-axis backward direction in FIG. 3). Furthermore, the short-circuit section 105 includes (i) a straight line section 105*a* (third straight line section) extending from the power supply section 104 in the direction (x-axis forward direction in FIG. 3) opposite to the direction in which the coaxial cable 200 is drawn out and (ii) a straight line section 105*c* (fourth straight line section) connected with an end of the straight line section 105*a* (an end of the straight line section 105*a* which end is farther from the power supply section 104) via an intermediary section 105*b* (second intermediary section) and extending in the direction in which the coaxial cable 200 is drawn out (x-axis backward direction in FIG. 3).

That is, each of the radiating element 101 and the short-circuit section 105 has an intermediary structure, and has a meander shape. In particular, the short-circuit section 105 short-circuits (i) the power supply section 104 containing the power supply point P and (ii) the internal ground 103 containing the power supply point Q, thereby forming a loop for impedance matching.

What is noteworthy in the antenna 100 in accordance with the present embodiment is that the internal ground 103 is made of minute conductor fragments. To be more specific, the internal ground 103 is made of rectangular conductor fragments, one side of each of which has a length substantially equal to a diameter of the coaxial cable 200. The internal ground 103 can be made of such minute conductor fragments because the substrate 500, capacitive-coupled with the external conductor 203 of the coaxial cable 200, serves as a ground.

As is obvious from FIG. 3, a distance D1 between the power supply section 104 and the intermediary section 101*b* of the radiating element 101 is substantially equal to a distance D2 between the power supply section 104 and the intermediary section 105*b* of the short-circuit section 105. That is, the length of the straight line section 101*a* is substantially equal to the length of the straight line section 105*a*. This configuration is intended to enhance a radiation efficiency of the antenna device.

(Dielectric Coating Film 107)

As illustrated in FIG. 4, the antenna 100 further includes a dielectric coating film 107. Similarly with the dielectric substrate 106, the dielectric coating film 107 is made of a material such as a thin polyimide film. The dielectric coating film 107 overlaps the thin film conductor section 110 so as to coat the thin film conductor section 110. The dielectric coating film 107 is attached to the thin film conductor section 110 and the dielectric substrate 106. Thus, the antenna 100 is configured such that the thin film conductor section 110 is sandwiched between the dielectric substrate 106 and the dielectric coating film 107.

The dielectric coating film 107 has an opening 107*a* which faces the power supply point P. The internal conductor 204 of the coaxial cable 200 is electrically connected with the power supply point P via the opening 107*a*. Furthermore, the dielectric coating film 107 has an opening 107*b* which faces the power supply point Q. The external conductor 203 of the coaxial cable 200 is electrically connected with the power supply point Q via the opening 107*b*.

(How to Provide Antenna Device 10 on Wireless Device)

Figure 5:
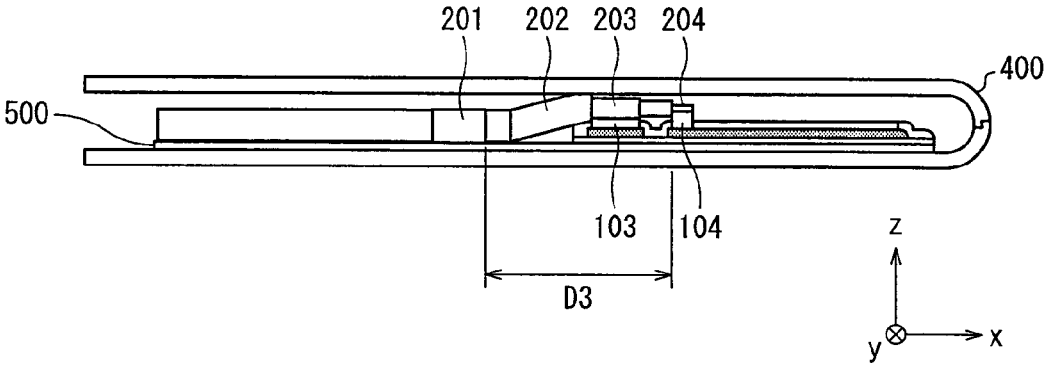
FIG. 5 is a cross sectional view illustrating an example of mounting an antenna device in accordance with the embodiment.

With reference to FIG. 5, the following description will discuss how to provide the antenna device 10 on a wireless device. FIG. 5 is a cross sectional view illustrating an example of mounting the antenna device 10 in accordance with the embodiment. In the example illustrated in FIG. 5, the antenna device 10 is provided inside a housing 400 constituting the wireless device.

Specifically, the substrate 500 is provided inside the housing 400. The substrate 500 is provided appressed to the housing 400, and is electrically connected with the housing 400. The antenna device 10 (i.e. each of the antenna 100 and the coaxial cable 200) is provided on the substrate 500.

As illustrated in FIG. 4, the substrate 500 is configured such that a metal layer 502 having a ground potential is laminated on a print substrate 501 (dielectric substrate), and a resist layer 503 is laminated on the metal layer 502.

The coaxial cable 200 has (i) one end connected with the antenna 100 and (ii) the other end connected with an RF module (not illustrated), and is provided between the antenna 100 and the RF module. According to the configuration, as illustrated in FIGS. 1 and 5, a part of the coaxial cable 200 which part is closer to the antenna 100 is provided on the substrate 500 so as to extend linearly from the power supply section 104 in a direction (x-axis backward direction in FIG. 5) opposite to a direction in which the short-circuit section 105 extends and to be substantially parallel to the radiating element 101 and the short-circuit section 105. Such configuration is employed in order to avoid interference between the coaxial cable 200 and the short-circuit section 105 (impedance matching pattern) and avoid such interference from making characteristics of the antenna device 10 unstable.

In particular, the coaxial cable 200 is provided on the substrate 500 so that the external conductor 203 is capacitive-coupled with the substrate 500. The capacitive coupling is realized by, for example, soldering, to the metal layer 502 of the substrate 500, the conductor 201 wound around or attached onto the coaxial cable 200. This allows the substrate 500 to be used as an external ground of the antenna 100. In this configuration, a distance D3 between the power supply section 104 and the conductor 201 (see FIG. 5) is determined in accordance with a desired operating band of the antenna 100.

The coaxial cable 200 is further fixed onto the substrate 500 by use of a fixing method such as adhesion. The internal conductor 204 of the coaxial cable 200 is fixed to the power supply section 104 while being electrically connected with the power supply section 104 through soldering, welding etc. The external conductor 203 of the coaxial cable 200 is fixed to the internal ground 103 while being electrically connected with the internal ground 103 through soldering, welding etc.

(Characteristics of Antenna Device 10)

Figure 6:
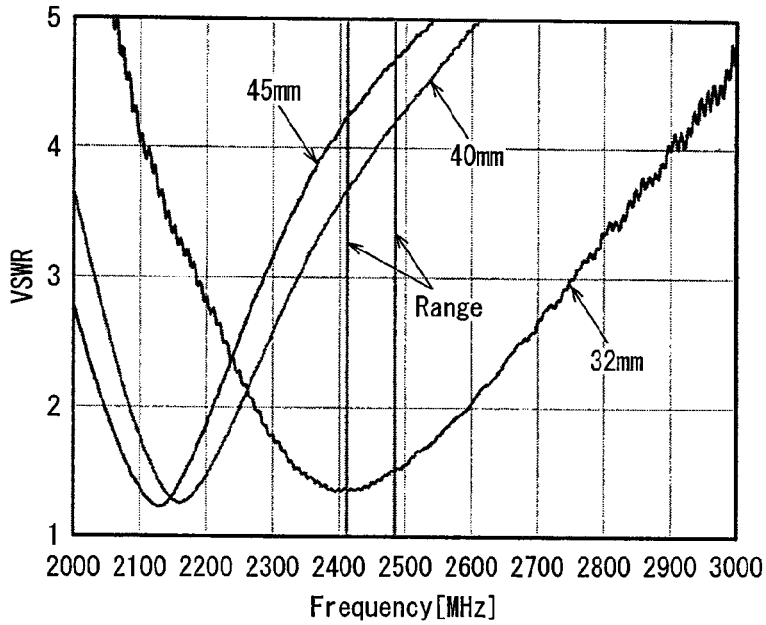
FIG. 6 is a graph illustrating a VSWR characteristic of an antenna device in accordance with the embodiment.
Figure 7:
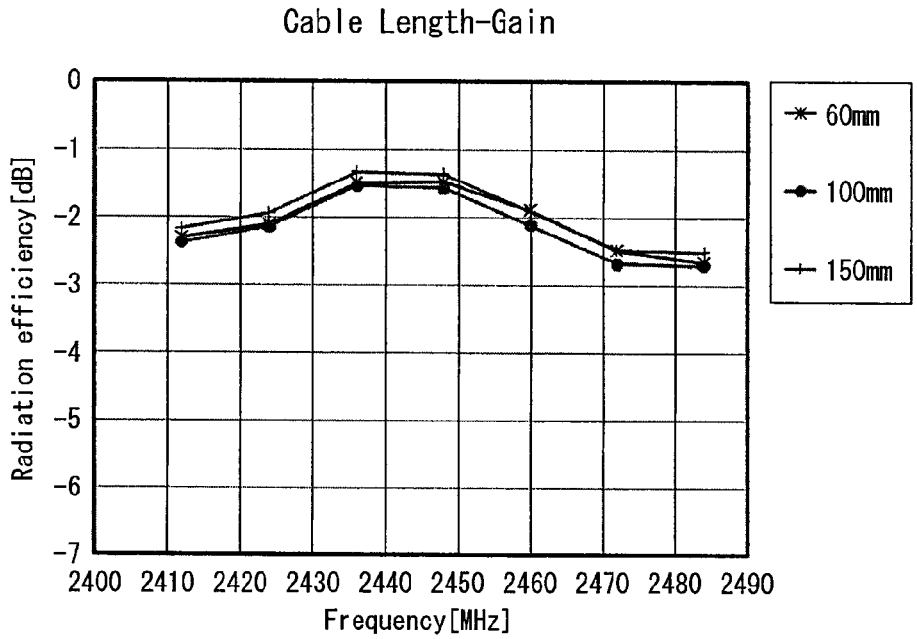
FIG. 7 is a graph illustrating a relation between a cable length of a coaxial cable and radiation characteristics in an antenna device in accordance with the embodiment.

With reference to FIGS. 6 and 7, the following description will discuss characteristics of the antenna device 10 configured as above in accordance with the embodiment.

FIG. 6 is a graph illustrating a VSWR (Voltage Standing Wave Ratio) characteristic of the antenna device 10 in accordance with the embodiment. The graph shows the VSWR characteristic measured in cases where the distance D3 between the power supply section 104 and the conductor 201 was 32 mm, 40 mm, and 45 mm.

According to the measured results, as the distance D3 is longer (i.e. as the conductor 201 is farther from the power supply section 104), the operating band can be shifted toward the lower frequency side. That is, by adjusting the distance D3, the antenna device 10 in accordance with the present embodiment can easily employ a desired band as the operating band. For example, according to the measured results, by setting the distance D3 to be 32 mm, it is possible to employ, as the operating band, a band ranging from 2412 MHz to 2482 MHz which is a frequency band of Wi-Fi.

FIG. 7 is a graph illustrating a relation, in the antenna device 10 in accordance with the present embodiment, between a cable length of the coaxial cable 200 and radiation characteristics. Note that the radiation characteristics were measured in cases where the cable length of the coaxial cable 200 was 60 mm, 100 mm, and 150 mm.

According to the measured results, even in a case where the cable length of the coaxial cable 200 was any of 40 mm, 90 mm, and 150 mm, similar gains were obtained in individual frequencies of the operating band (ranging from 2412 MHz to 2482 MHz). This shows that the cable length of the coaxial cable 200 does not affect the radiation characteristics of the antenna device 10. That is, according to the antenna device 10, it is not necessary to take the cable length of the coaxial cable 200 into consideration when designing the antenna device 10. As such, a high degree of freedom in design is achieved.

Figure 8:
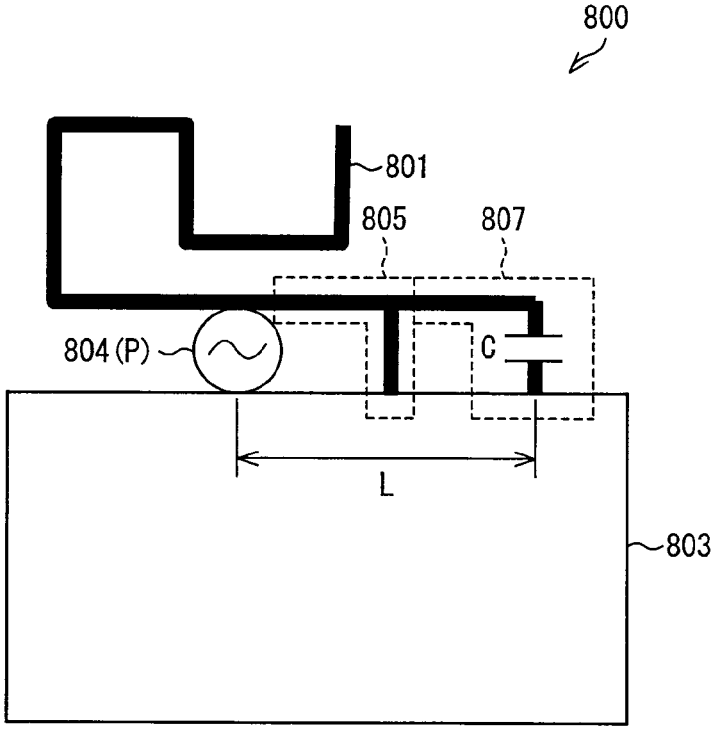
FIG. 8 schematically illustrates a configuration of an antenna device.

FIG. 8 schematically illustrates a configuration of the antenna device 10. An antenna 800 illustrated in FIG. 8 has a substantially equivalent configuration to that of the antenna device 10.

In the antenna 800 illustrated in FIG. 8, a radiating element 801 corresponds to the radiating element 101, and a ground 803 corresponds to the internal ground 103 and the substrate (external ground) 500. A path 805 from a power supply section 804 containing the power supply point P to the ground 803 corresponds to the short-circuit section 105, and a path 807 from the ground 803 to a capacitor C corresponds to the external conductor 203 of the coaxial cable 200. The capacitor C corresponds to a capacitor between the external conductor 203 of the coaxial cable 200 and the conductor 201, i.e. a capacitor between the external conductor 203 of the coaxial cable 200 and the substrate 500.

That is, a distance L from the power supply section 804 containing the power supply point P to the capacitor C corresponds to the distance D3 from the power supply section 104 to the conductor 201. Therefore, results obtained by measuring radiation characteristics of the antenna 800 while changing the distance L are similar to results obtained by measuring radiation characteristics of the antenna device 10 while changing the distance D3.

Figure 9:
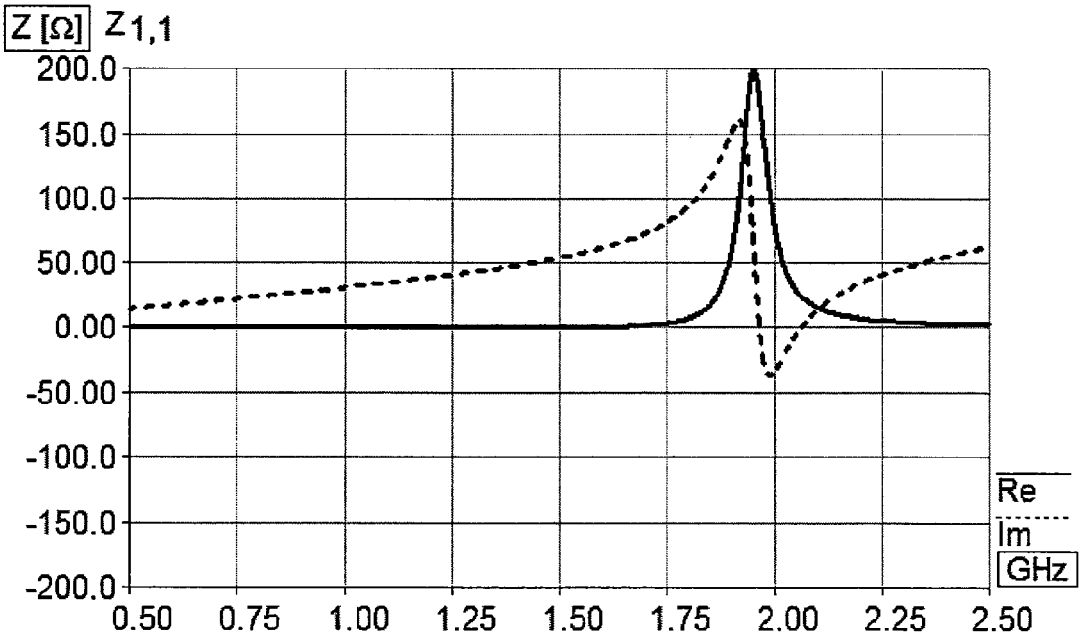
FIG. 9 is a graph illustrating input impedance of an antenna in a case where capacitive coupling C is not provided.
Figure 10:
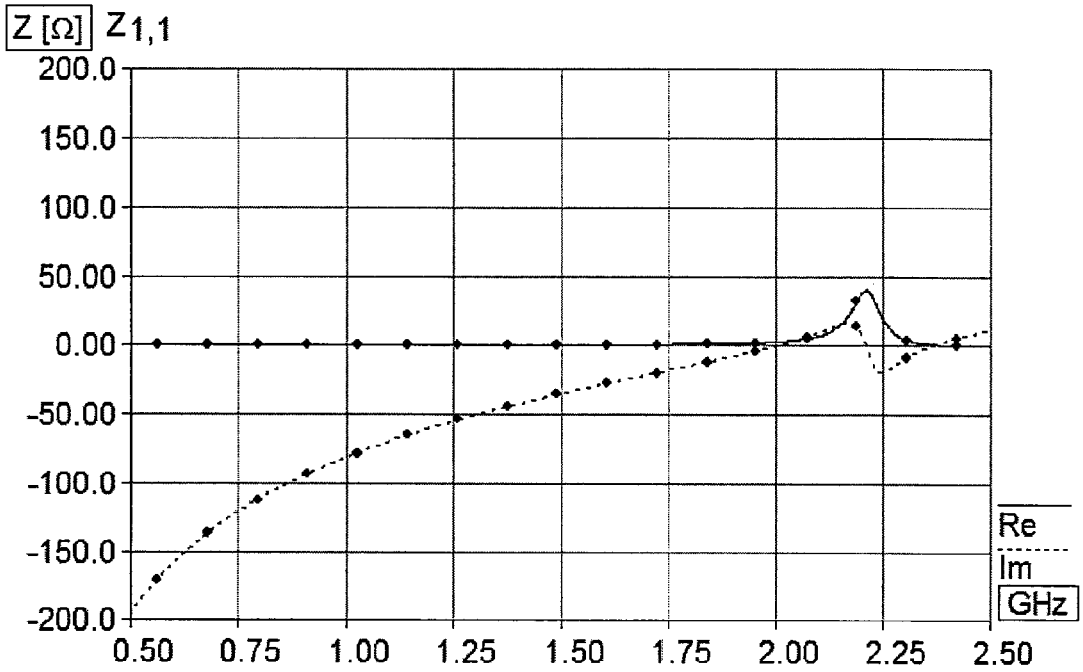
FIG. 10 is a graph illustrating input impedance of an antenna which is obtained in a case where the capacitive coupling C is 1 pF and the distance L is 5 mm.

FIGS. 9 to 13 are graphs illustrating the radiation characteristics of the antenna 800. In particular, FIG. 9 is a graph illustrating input impedance of the antenna 800 in a case where capacitive coupling C is not provided. FIG. 10 is a graph illustrating input impedance of the antenna 800 which is obtained in a case where the capacitive coupling C is 1 pF and the distance L is 5 mm.

Figure 11:
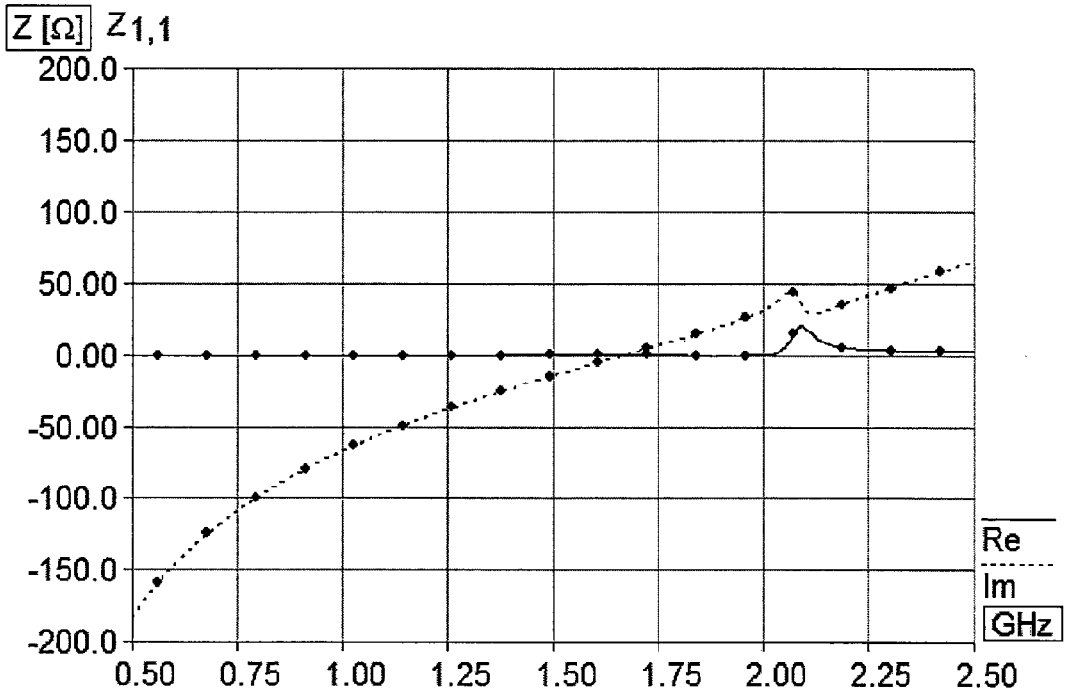
FIG. 11 is a graph illustrating input impedance of an antenna which is obtained in a case where the capacitive coupling C is 1 pF and the distance L is 10 mm.
Figure 12:
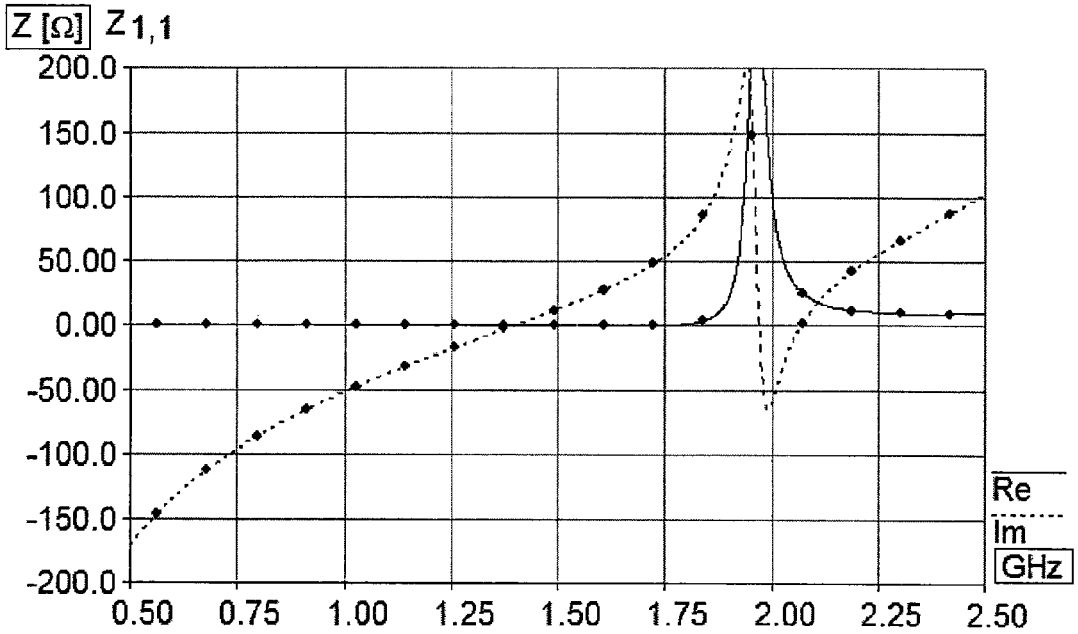
FIG. 12 is a graph illustrating input impedance of an antenna which is obtained in a case where the capacitive coupling C is 1 pF and the distance L is 15 mm.
Figure 13:
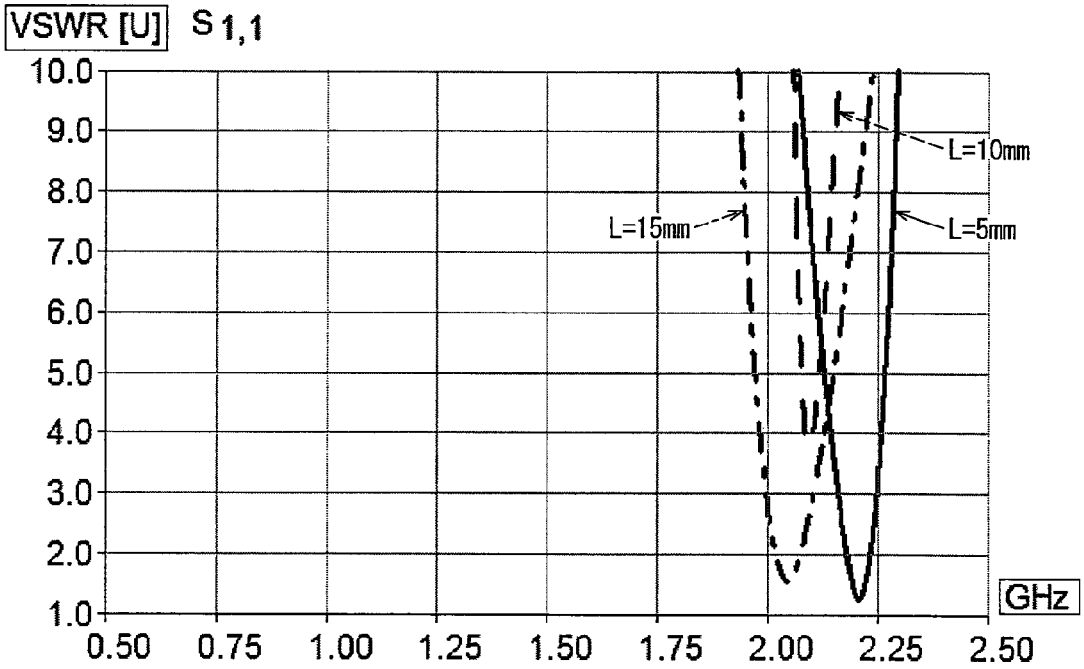
FIG. 13 is a graph illustrating a VSWR characteristic of an antenna.

Furthermore, FIG. 11 is a graph illustrating input impedance of the antenna 800 which is obtained in a case where the capacitive coupling C is 1 pF and the distance L is 10 mm. FIG. 12 is a graph illustrating input impedance of the antenna 800 which is obtained in a case where the capacitive coupling C is 1 pF and the distance L is 15 mm. FIG. 13 is a graph illustrating a VSWR characteristic of the antenna 800.

The measured results illustrated in FIGS. 9 and 10 show that the provision of the path 805 causes inductive characteristics to occur in a low frequency region. The measured results also show that the provision of the capacitive coupling C causes a reduction in inductive characteristics. Furthermore, the measured results illustrated in FIGS. 10 to 13 show that as the distance L is longer, a resonance frequency is lower. This seems to be because as the distance L is longer, the inductive characteristics are stronger.

These measured results demonstrate that changing of the distance D3 in the antenna device 10 can change the operating band of the antenna device 10.

(Effects)

As has been described, the antenna device 10 in accordance with the present embodiment employs a configuration in which the external conductor 203 of the coaxial cable 200 is capacitive-coupled with the substrate 500 so that the substrate 500 serves as an external ground of the antenna 100.

This configuration allows the antenna device 10 in accordance with the present embodiment to minimize the internal ground 103 directly connected with the external conductor 203 of the coaxial cable 200, without limiting an operation of the antenna device 10 as an inverted F antenna.

Consequently, the antenna device 10 in accordance with the present embodiment can be easily provided on a narrow space of a wireless device on which the antenna device 10 is to be mounted. This makes it unnecessary to enlarge the space where the antenna device 10 is to be mounted, so that the antenna device 10 does not affect the design of the wireless device.

Furthermore, the antenna device 10 in accordance with the present embodiment has a configuration in which the operating band is determined depending on the position of the conductor 201 with respect to the power supply section 104. Therefore, by appropriately adjusting the position of the conductor 201 with respect to the power supply section 104, it is possible to easily obtain a desired operating band.

It should be noted that the antenna device 10 in accordance with the present embodiment requires only the conductor 201 to be added to a configuration of a conventional antenna device and has a relatively simple configuration. Accordingly, the antenna device 10 yields the various effects mentioned above, without increasing costs.

Furthermore, the antenna device 10 in accordance with the present embodiment can be provided inside a wireless device on which the antenna device 10 is to be mounted, without distancing the antenna device 10 from members which inhibit radiation in a conventional antenna device, such as a print substrate, a metal housing, metal members, and electronic members. Even when the antenna device 10 is provided in such a way, appropriately adjusting the position of the conductor 201 with respect to the power supply point P allows preventing decrease in radiation characteristics. Also in this regard, the antenna device 10 in accordance with the present embodiment can be easily provided on a narrow space of a wireless device on which the antenna device 10 is to be mounted. This makes it unnecessary to enlarge the space where the antenna device 10 is to be mounted, so that the antenna device 10 does not affect the design of the wireless device.

[Summary]

As has been described, the antenna device in accordance with the present embodiment includes: an antenna including a radiating element and an internal ground; a coaxial cable whose internal conductor is connected with the radiating element and whose external conductor is connected with the internal ground; and an external ground capacitive-coupled with the external conductor of the coaxial cable.

With the arrangement, both of the internal ground and the external ground serve as a ground (bottom board) which is an essential component of a monopole antenna (including an inverted F antenna). Therefore, for example, by using, as the external ground, a substrate originally included in a wireless device including the antenna device, it is possible to reduce the area of the internal ground without limiting a function of a monopole antenna. This allows realizing an antenna whose mounting area is smaller than that of a conventional antenna.

It is preferable to arrange the antenna device such that the antenna, which is an inverted F antenna, further includes a short-circuit section for short-circuiting the radiating element and the internal ground.

With the arrangement, it is possible to easily perform impedance matching between the antenna and the coaxial cable.

Furthermore, it is preferable to arrange the antenna device such that the radiating element includes: a first straight line section extending from a power supply section in a direction opposite to a direction in which the coaxial cable is drawn out, the power supply section being connected with the internal conductor of the coaxial cable; and a second straight line section connected via a first intermediary section with an end of the first straight line section which end is farther from the power supply section and extending from the first intermediary section in the direction in which the coaxial cable is drawn out, and the short-circuit section includes: a third straight line section extending from the power supply section in the direction opposite to the direction in which the coaxial cable is drawn out; and a fourth straight line section connected via a second intermediary section with an end of the third straight line section which end is farther from the power supply section and extending from the second intermediary section in the direction in which the coaxial cable is drawn out, and an end of the fourth straight line section which end is farther from the second intermediary section is connected with the internal ground.

With the arrangement, the antenna can be more compact. This allows realizing an antenna having a smaller mounting area.

Furthermore, it is preferable to arrange the antenna device such that the first straight line section and the third straight line section have identical lengths, and the second straight line section and the fourth straight line section have identical lengths.

With the arrangement, an entire length of the radiating element is substantially equal to an entire length of the short-circuit section, and a resonance point of the radiating element is substantially in line with a resonance point of the short-circuit section, so that the operating band of the antenna can be widened. Furthermore, since a location of the end of the radiating element with respect to the power supply point is substantially equal to a location of the end of the short-circuit section with respect to the power supply point, it is possible to enhance radiation efficiency of the antenna.

Furthermore, it is preferable to arrange the antenna device such that the external conductor of the coaxial cable is capacitive-coupled with the external ground by connecting, with the external ground, a conductor wound around or attached onto a coverture of the coaxial cable.

With the arrangement, by simply winding the conductor around or attaching the conductor onto the coverture of the coaxial cable and connecting the conductor with the external ground, it is easily possible to capacitive-couple the external conductor of the coaxial cable with the external ground so as to obtain an external ground with a wide area.

Furthermore, it is preferable to arrange the antenna device such that a position where the conductor is wound around or attached onto the coverture of the coaxial cable is set in accordance with an operating band in which the antenna operates.

With the arrangement, by simply adjusting the location of the conductor, it is possible to easily obtain a desired operating band. Furthermore, since an operating band according to an application purpose of the antenna can be obtained without changing a configuration of the antenna, it is possible to improve versatility of the antenna.

An antenna mounting method in accordance with the present embodiment is an antenna mounting method for mounting, on a wireless device, an antenna including a radiating element and an internal ground, said antenna mounting method comprising the steps of: connecting an internal conductor of a coaxial cable with the radiating element and connecting an external conductor of the coaxial cable with the internal ground; and capacitive-coupling the external conductor of the coaxial cable with an external ground included in the wireless device.

With the antenna mounting method, both of the internal ground and the external ground serve as a ground (bottom board) which is an essential component of a monopole antenna (including an inverted F antenna). Therefore, for example, by using, as the external ground, a substrate originally included in the wireless device, it is possible to reduce the area of the internal ground to be mounted on the wireless device, without limiting a function of a monopole antenna. This allows mounting, on the wireless device, an antenna whose mounting area is smaller than that of a conventional antenna.

The present invention is not limited to the description of the embodiments above, but may be altered by a skilled person within the scope of the claims. An embodiment based on a proper combination of technical means disclosed in different embodiments is encompassed in the technical scope of the present invention.

For example, embodiments obtained by changing the kind of the antenna, the structure of the antenna, the shape of the antenna, the operating band of the antenna etc. in the above embodiments are also encompassed in the technical scope of the present invention.

In the above embodiments, the description has dealt with an example in which the present invention is applied to an inverted F antenna. However, the present invention is not limited to this, and may be applied to various antennas such as a monopole antenna.

Furthermore, in the above embodiments, the description has dealt with an example in which the present invention is applied to an antenna having one radiating element. However, the present invention is not limited to this case, and may be applied to an antenna having two or more radiating elements (e.g. an antenna having a radiating element for low frequency and a radiating element for high frequency).

In either case, by appropriately changing the shape, the size, the position, the layout, the material etc. of individual sections (e.g. radiating element, internal ground, power supply section, short-circuit section, coaxial cable, and conductor) according to necessity, the operating band of the antenna can be broadened so that a target frequency band becomes the operating band, without enlarging the size of the antenna, similarly with the antenna device 10 in accordance with the embodiment.

INDUSTRIAL APPLICABILITY

The antenna device and the antenna mounting method of the present invention are applicable to various wireless devices which carry out wireless communications using an antenna device, and are particularly suitable for use in wireless devices such as smart phones, mobile phones, and electronic book readers etc. whose operating bands are broadening and which are required of downsizing and having good design.

REFERENCE SIGNS LIST

10 Antenna device
100 Antenna
101 Radiating element
103 Internal ground
104 Power supply section
105 Short-circuit section
106 Dielectric substrate
200 Coaxial cable
201 Conductor
202 Coverture
203 External conductor
204 Internal conductor
205 Insulator
400 Housing
500 Substrate (external ground)

The invention claimed is:

1. An antenna device, comprising:

an inverted F antenna including a radiating element and an internal ground and further including a short-circuit section for short-circuiting the radiating element and the internal ground;

a coaxial cable whose internal conductor is connected with the radiating element and whose external conductor is connected with the internal ground; and an external ground capacitive-coupled with the external conductor of the coaxial cable by connecting, with the external ground, a conductor wound around or attached onto a coverture of the coaxial cable.

2. The antenna device as set forth in claim 1, wherein the radiating element includes: a first straight line section extending from a power supply section in a direction opposite to a direction in which the coaxial cable is drawn out, the power supply section being connected with the internal conductor of the coaxial cable; and a second straight line section connected via a first intermediary section with an end of the first straight line section which end is farther from the power supply section and extending from the first intermediary section in the direction in which the coaxial cable is drawn out, and the short-circuit section includes: a third straight line section extending from the power supply section in the direction opposite to the direction in which the coaxial cable is drawn out; and a fourth straight line section connected via a second intermediary section with an end of the third straight line section which end is farther from the power supply section and extending from the second intermediary section in the direction in which the coaxial cable is drawn out, and an end of the fourth straight line section which end is farther from the second intermediary section is connected with the internal ground.

3. The antenna device as set forth in claim 2, wherein the first straight line section and the third straight line section have identical lengths, and the second straight line section and the fourth straight line section have identical lengths.

4. The antenna device as set forth in claim 1, wherein a position where the conductor is wound around or attached onto the coverture of the coaxial cable is set in accordance with an operating band in which the antenna operates.

5. The antenna device as set forth in claim 1, wherein the conductor wound around or attached onto the coverture of the coaxial cable is distanced from a power supply section of the radiating element connected with the internal conductor of the coaxial cable.

6. An antenna mounting method for mounting, on a wireless device, an inverted F antenna including a radiating element and an internal ground and further including a short-circuit section for short-circuiting the radiating element and the internal ground, said antenna mounting method comprising the steps of:

connecting an internal conductor of a coaxial cable with the radiating element and connecting an external conductor of the coaxial cable with the internal ground; and capacitive-coupling the external conductor of the coaxial cable with an external ground included in the wireless device by connecting, with the external ground, a conductor wound around or attached onto a coverture of the coaxial cable.

7. The method as set forth in claim 6 further comprising the step of setting a position where the conductor is wound around or attached onto the coverture of the coaxial cable in accordance with an operating band in which the antenna operates.

8. The method as set forth in claim 6, wherein the conductor wound around or attached onto the coverture of the coaxial cable is distanced from a power supply section of the radiating element connected with the internal conductor of the coaxial cable, and the method further comprises the step of adjusting a distance between the conductor wound around or attached onto the coverture of the coaxial cable and the power supply section.

* * * * *